US006779689B2

(12) United States Patent
Flaig et al.

(10) Patent No.: US 6,779,689 B2
(45) Date of Patent: Aug. 24, 2004

(54) OVALOID DISPENSING CONTAINER

(75) Inventors: Raymond Michael Flaig, Stamford, CT (US); Dean Rainey, Clinton, CT (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 19 days.

(21) Appl. No.: 10/348,183

(22) Filed: Jan. 21, 2003

(65) Prior Publication Data

US 2004/0140325 A1 Jul. 22, 2004

(51) Int. Cl.[7] ..... B67D 5/06
(52) U.S. Cl. ..... 222/182; 222/321.7; 222/556
(58) Field of Search ..... 222/182, 212, 222/321.1, 321.7, 321.9, 554, 556; D9/300

(56) References Cited

U.S. PATENT DOCUMENTS 4,124,151 A * 11/1978 Hazard ..... 222/498
4,801,054 A * 1/1989 Nycz ..... 222/545
D375,455 S * 11/1996 Uhl et al. ..... D9/300
D399,754 S 10/1998 Bertolini et al. ..... D9/592
D404,295 S 1/1999 Bertolini et al. ..... D9/300
5,873,491 A * 2/1999 Garcia et al. ..... 222/95
5,996,850 A * 12/1999 Morali et al. ..... 222/173
6,189,739 B1 * 2/2001 von Schuckmann ..... 222/182
6,202,896 B1 * 3/2001 Bonningue ..... 222/321.1
D441,640 S * 5/2001 Reinoso ..... D9/300
6,299,369 B1 * 10/2001 Baines et al. ..... 401/75
6,305,581 B1 * 10/2001 Bonningue et al. ..... 222/321.3
6,364,166 B1 * 4/2002 Ritsche et al. ..... 222/153.13
2003/0160070 A1 * 8/2003 Lee ..... 222/321.7

* cited by examiner

*Primary Examiner*—Joseph A. Kaufman
(74) *Attorney, Agent, or Firm*—Milton L. Honig

(57) ABSTRACT

An ovaloid dispensing container is provided which includes an ovaloid bottle and an ovaloid overcap. The bottle is fitted with a fluid dispensing device such as a pump assembly. An oval collar is supported on the bottle and has an outwardly flaring shoulder. The overcap is formed with a surrounding wall and a mouth defining an open end. The surrounding wall tapers outwardly while the mouth defines a downwardly convex perimeter on front and rear faces of the surrounding wall. The shoulder functions as a camming surface against which the overcap perimeter slides to assist in twist-off removal of the cap.

15 Claims, 4 Drawing Sheets

OVALOID DISPENSING CONTAINER

BACKGROUND OF THE INVENTION

1. Field of the Invention

The invention relates to an ovaloid package for dispensing fluids.

2. The Related Art

Ovaloid packages have special aesthetic and functional appeal. While not being unique, this shape differs considerably from the normal round ones. On store shelves they present a better face. Printed information can be better displayed than on a round shape, the latter having a narrower viewable profile. Ovaloid containers are also more ergonomically grippable by the hand.

The art has generated a number of engineering approaches to ovaloid packaging. For instance, U.S. Pat. No. Des. 399,754 (Bertolini et al.) describes an ovaloid dispensing container sealed with a flip-top cap attached by hinge to the roof of an ovaloid bottle. Pumps having this shape are also known from U.S. Pat. No. Des. 404,295 (Bertolini et al.). These pumps are fitted with round overcaps or are without any cap over the pump nozzle. Improved ornamental design of ovaloid dispensers has been hindered by the lack of an engineered solution providing an overcap separate from the dispensing bottle and which can function to ensure a good seal.

Accordingly, a challenge for the present invention was to enhance aesthetics of an ovaloid container by engineering a sealable ovaloid overcap.

SUMMARY OF THE INVENTION

An ovaloid dispensing container is provided which includes:

(i) an ovaloid bottle with an open end fitted with a fluid dispensing device, the bottle near the open end having an ovaloid collar with an outwardly flaring shoulder; and (ii) an ovaloid overcap including a roof at a closed end thereof and a surrounding wall with a mouth defining an open end, the surrounding wall tapering outwardly, the mouth defined by a downwardly convex perimeter on a front and rear face of the surrounding wall, the shoulder functioning as a camming surface against which the overcap perimeter slides to assist in twist-off removal of the overcap.

Among alternative fluid dispensing devices are a pump assembly and a sealable aperture (basically a pour spout). The aperture embodiment can be regulated for flow and non-flow operation by insertion of a snap-on plug or by a threaded screw cap. Most preferred is the pump assembly embodiment. In all instances, there still will be required the ovaloid overcap as the outer sealing element.

In the preferred embodiment, the collar is bordered by upper and lower edges, these edges having different curvatures resulting in a surface of continuously changing distance between the edges. Upper and lower openings are formed by the respective upper and lower edges of the collar. An outwardly projecting landing traces the lower edge of the collar. Furthermore, a groove runs along the outer surface of the collar adjacent the landing. This groove allows coupling with a bead positioned on an inner surface of the overcap.

Additionally the collar includes an inner surface from which a curved gripping member projects downwardly in a direction toward the lower opening. The gripping member defines at least two curved segments. Each of these segments includes a pair of downwardly projecting feet separated from one another by a notch. An inner surface of the curved segments includes an inwardly oriented bead. The feet along a bottom edge thereof adjacent the notch have a bevel. At least one supporting rib connects the inner surface of the collar to an outer surface of the gripping member.

The pump assembly includes a movable nozzle and actuator. A circular screwcap surrounds the nozzle. The screwcap is defined by a circumferential skirt bounding an upper and lower border. The skirt has an outer surface with circumferential first and second areas. The first area is adjacent the upper border and has a smaller radial protrusion than the second area. The lower border seats onto a support element projecting from a neck of the bottle.

An Airspray Corporation mechanical non-aerosol pump is suitable as a pumping mechanism for the present invention. The Airspray pump is described in WO 97/13585 (Van der Heijden), herein incorporated by reference. It is to be understood that the present invention is not limited to an Airspray mechanism for the pump embodiment.

The pump embodiment according to the present invention can be fashioned from four custom components delivered to a production line as two assemblies. These assemblies are designed to work with a custom bottle finish to allow for actuator orientation, collar orientation and attachment of an overcap assembly to the bottle. The custom parts are the pump actuator, ring, collar and overcap. The two assemblies utilized to form the container include a pump assembly (having actuator, ring and pump dispensing device) and an overcap assembly (having overcap and collar).

A special feature of the pump assembly is the ring. The first circumferential area along the upper border of the ring has a narrower outward projection than the second. The first area may cover about 20% of the skirt and the second area the remaining about 80%. The first area through its smaller "diameter" allows the curved gripping member to easily fit over and orient the collar onto the ring. The inner surface of the curved segments of the gripping member then further slide over the second area of the skirt. Final downward pressure forces the feet and notch which are now aligned to seat over a lug on the bottle. The notch-lug engagement also provides an anti-rotational feature to the collar. The engagement is not engineered to be permanent, but is strong enough to withstand movement in a normal use environment.

The overcap is engaged to the collar through a continuous retention bead on the inner wall of the overcap. This mates with the groove on the outer surface of the collar.

BRIEF DESCRIPTION OF THE DRAWING

Further advantages and features of the present invention will become more apparent through consideration of the following drawing in which.

DETAILED DESCRIPTION OF THE INVENTION

Figure 1:
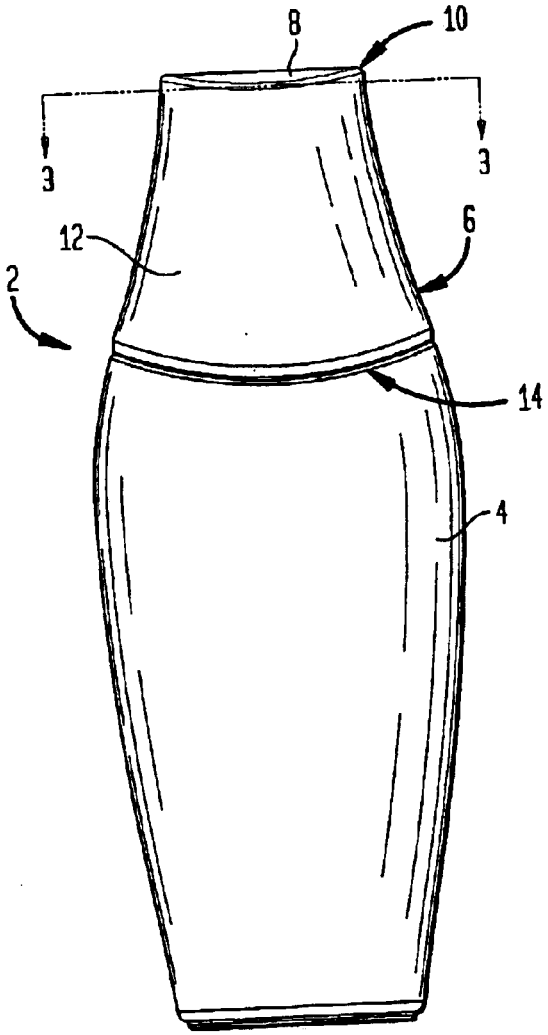
FIG. 1 is a front elevational view of the ovaloid dispensing container.
Figure 2:
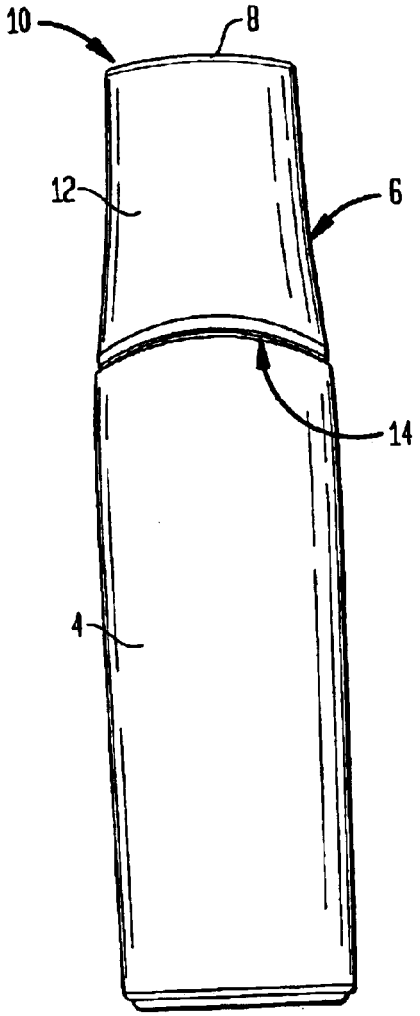
FIG. 2 is a side elevational view of the container shown in FIG. 1.
Figure 3:
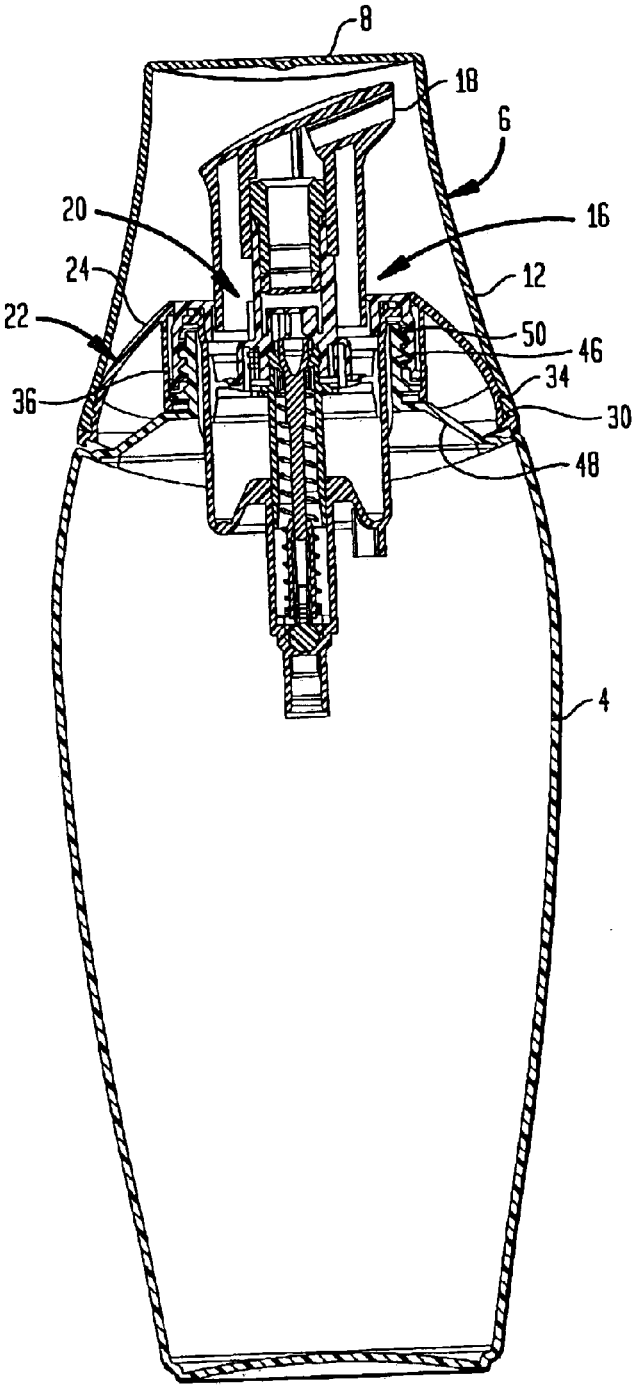
FIG. 3 is a cross-sectional view along lines 3—3 of the first embodiment shown in FIG. 1.

A first embodiment of the present invention is illustrated in FIG. 1. The oval dispensing container 2 is shown in a closed arrangement. The container includes an oval bottle 4 closed with an oval overcap 6.

The overcap has a roof 8 at a closed end 10 thereof and a surrounding wall 12. The wall includes a mouth 14 defining an open end of the overcap. The surrounding wall tapers outwardly eventually forming the mouth as an outwardly convex perimeter on front and rear faces of the surrounding wall. The bottle 4 on its open end is fitted with a fluid dispensing device which in this embodiment is pump assembly 16. A vertically movable nozzle 18 and an actuator 20 form part of the pump assembly.

Figure 8:
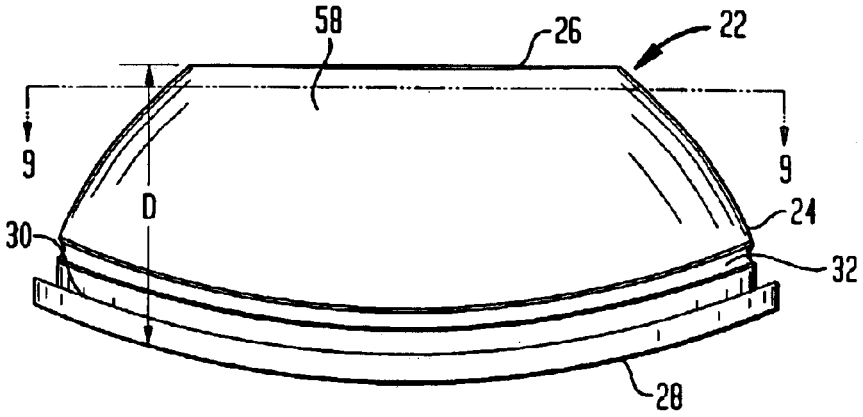
FIG. 8 is a plan view of the collar utilized for the first embodiment.

FIG. 8 illustrates an oval collar 22 fittable over the bottle 4 near the open end. The collar is oval with an outwardly flaring shoulder 24. Upper and lower edges 26, 28 border the collar. These edges have different curvatures resulting in a surface with a continuously changing distance D between the edges. An outwardly projecting landing 30 protrudes from an outer surface of the collar along the lower edge 28.

Adjacent the landing is a groove 32 for detachably coupling with a bead 34 positioned on an inner surface of the overcap. On an inner surface of the collar is a curved gripping member 36 oriented downwardly in a direction of the lower edge.

Figure 9:
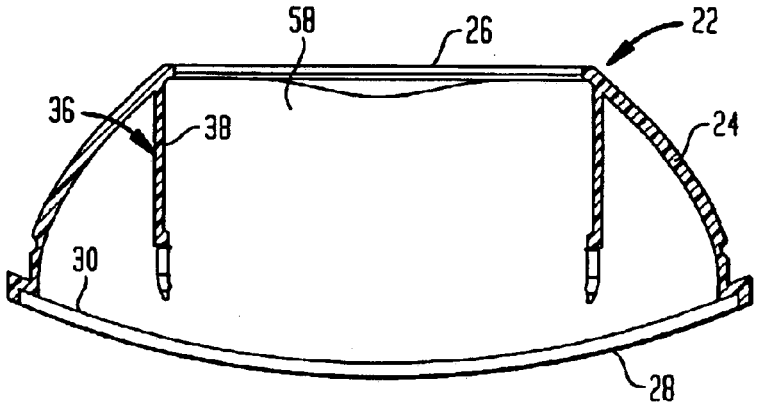
FIG. 9 is a cross-sectional view along line 9—9 of FIG. 8.
Figure 10:
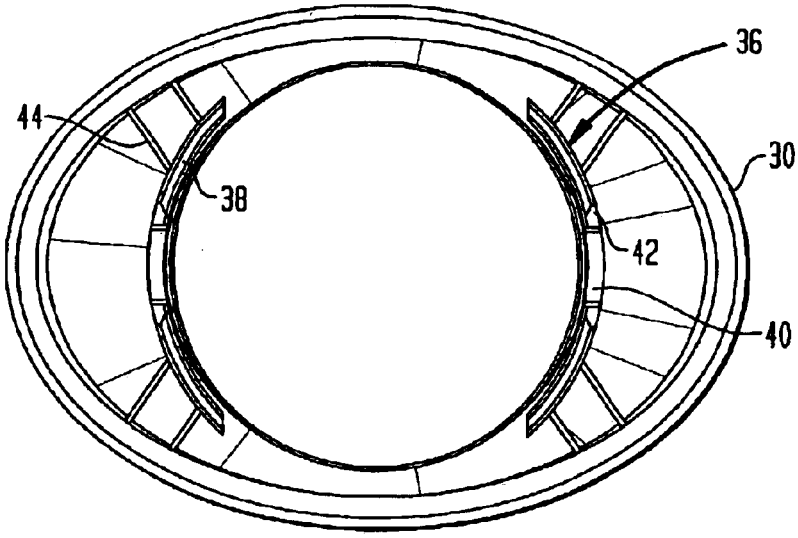
FIG. 10 is a bottom plan view of the collar shown in FIG. 8.

FIG. 9 best illustrates the gripping member which is formed by two curved segments 38. Each of the segments includes a pair of downwardly projecting feet separated from one another by a notch 40, the latter being best illustrated in FIG. 10. A bevel 42 is cut into the feet along a bottom edge thereof adjacent the notch. A pair of supporting ribs 44 join the inner surface of the collar to the outer surface of each of the four feet.

Figure 4:
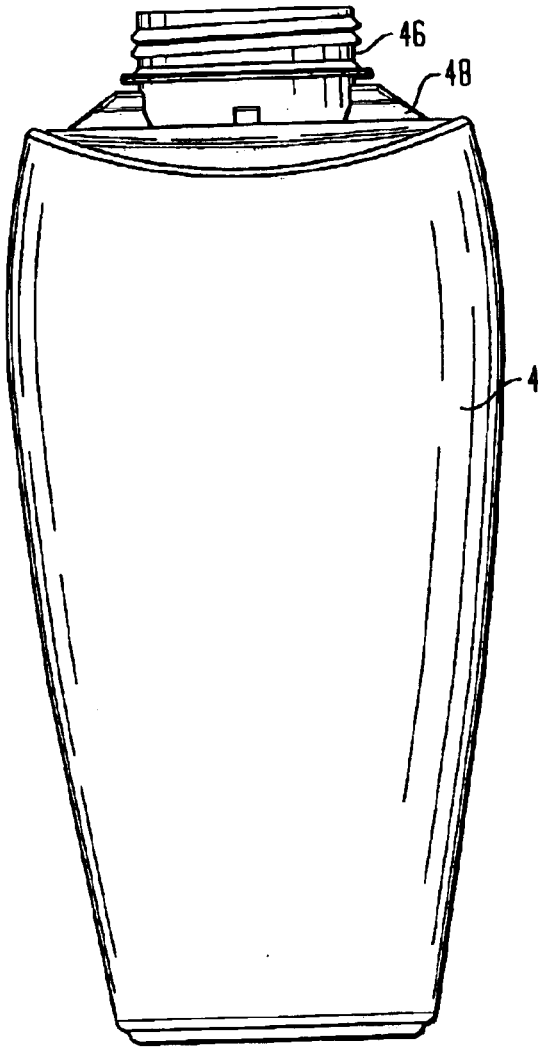
FIG. 4 is a front elevational view of the ovaloid bottle according to the first embodiment.
Figure 5:
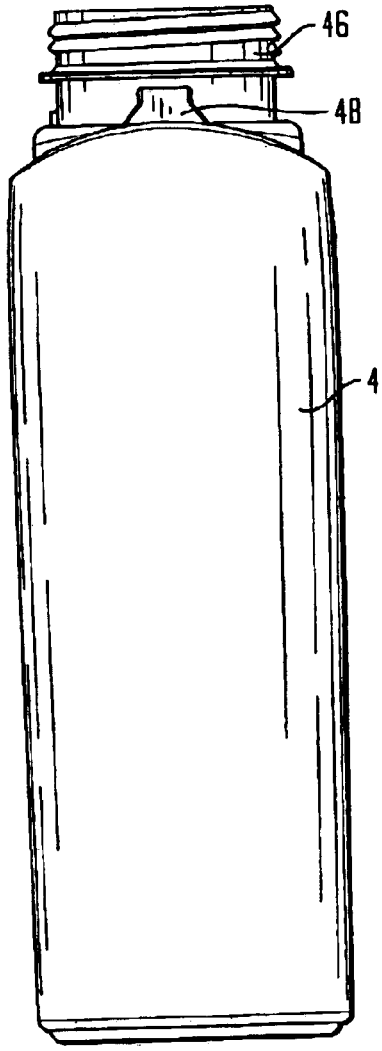
FIG. 5 is a side elevational view of the bottle shown in FIG. 4.

FIG. 4 and 5 illustrate the bottle 4 having a neck 46 circumscribed with a screw thread.

Figure 6:
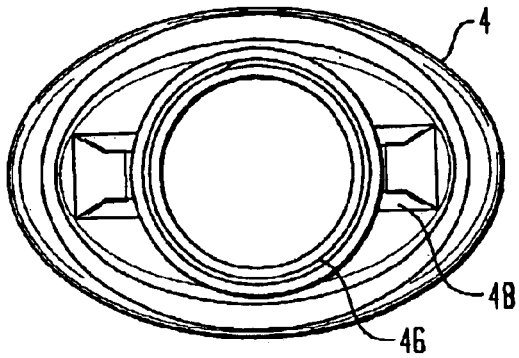
FIG. 6 is a top elevational view of the bottle shown in FIG. 4.

FIG. 6 illustrates a pair of rhomboidal lugs 48 molded into the bottle. These lugs are positioned against a lower portion of the neck and are equidistant from one another.

Figure 7:
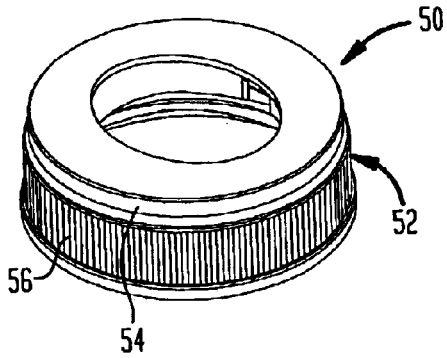
FIG. 7 is a perspective view of the ring which is utilized in the first embodiment.

FIG. 7 illustrates a ring 50 which threadably engages the bottle neck 46. The ring is defined by a circumferential skirt 52 bounding an upper and lower border of the ring. The skirt 52 has an outer surface with circumferential first and second areas 54, 56. The first area is adjacent the upper border of the ring and has a smaller radial protrusion than the second area. The first area encompasses about 20% of the skirt with the remaining approximately 80% being covered by the second area. Vertical striations are molded onto the second area to assist as a friction fit against the gripping member of the collar.

The various parts of the container described above are assembled in the following manner. Pump assembly 16 is fitted with ring 50. The pump assembly is inserted into the bottle and the ring threadedly turned against the neck thereby sealably securing the pump assembly to the bottle. Overcap 6 is forced over the collar 22. These parts are releasably locked into one another as bead 34 on the inner surface of the overcap engages into groove 32 of the collar.

The resultant overcap assembly is positioned over the bottle assembly so that the nozzle 18 passes through the upper opening 58 of the collar. Downward pressure is applied to the overcap thereby forcing the segments of the gripping member to slide over the first and then second area of the ring skirt. A final downward pressure causes the two notches 40 of the gripping member to seat over the two respective lugs 48 molded onto the bottle.

The term "ovaloid" is meant to cover not only continuously curving oval cross-sectional shapes but also none continuously curvatured shapes which have oval characteristics. Illustrative is an oval whose side faces are squared-off rather than being curved, for which the bottle of U.S. Pat. No. Des. 399,754 is illustrative.

The term "comprising" is meant not to be limiting to any subsequently stated elements but rather to encompass non-specified elements of major or minor functional importance. In other words the listed steps, elements or options need not be exhaustive. Whenever the words "including" or "having" are used, these terms are meant to be equivalent to "comprising" as defined above.

What is claimed is:

1. An ovaloid dispensing container comprising:

(i) an ovaloid bottle with an open end fitted with a fluid dispensing device, the bottle near the open end having an ovaloid collar with an outwardly flaring shoulder; and (ii) an ovaloid overcap comprising a roof at a closed end thereof and a surrounding wall with a mouth defining an open end, the surrounding wall tapering outwardly, the mouth defined by a downwardly convex perimeter on a front and rear face of the surrounding wall, the shoulder functioning as a camming surface against which the overcap perimeter slides to assist in twist-off removal of the overcap.

2. The container according to claim 1 wherein the collar is bordered by upper and lower edges, the edges having different curvatures resulting from a surface of continuously changing distance between the upper and lower edges.

3. The container according to claim 1 wherein the fluid dispensing device is an aperture sealable by insertion of a snap-on plug or by a threaded cap.

4. The container according to claim 1 wherein the fluid dispensing device is a pump assembly.

5. The container according to claim 4 wherein the pump assembly includes a vertically movable nozzle and actuator.

6. The container according to claim 5 further comprising a circular ring surrounding the nozzle.

7. The container according to claim 6 wherein the ring is defined by a circumferential skirt bounding an upper and lower border, the skirt having an outer surface with circumferential first and second areas, the first area being adjacent the upper border and having a smaller radial protrusion than the second area.

8. The container according to claim 1 wherein the collar on an outer surface thereof comprises an outwardly projecting landing.

9. The container according to claim 8 wherein the collar further comprises a groove in the outer surface adjacent the landing for coupling with a bead positioned on an inner surface of the overcap.

10. The container according to claim 1 wherein the collar further comprises an inner surface from which a curved gripping member projects downwardly.

11. The container according to claim 10 wherein the gripping member defines at least two curved segments.

12. The container according to claim 11 wherein each of the at least two segments includes a pair of downwardly projecting feet separated from one another by a notch.

13. The container according to claim 11 further comprising a bead projecting inwardly from an inner surface of the curved segments.

14. The container according to claim 12 wherein the feet along a bottom edge thereof have a bevel adjacent the notch.

15. The container according to claim 10 further comprising at least one supporting rib joining the inner surface of the collar to an outer surface of the gripping member.

* * * * *